US009194672B1

(12) United States Patent
Hyde

(10) Patent No.: US 9,194,672 B1
(45) Date of Patent: Nov. 24, 2015

(54) SHOCK-ABSORBING BOLT FOR A CROSSBOW

(71) Applicant: BowTech, Inc., Eugene, OR (US)

(72) Inventor: Tony E. Hyde, Monroe, OR (US)

(73) Assignee: BowTech, Inc., Eugene, OR (US)

( * ) Notice: Subject to any disclaimer, the term of this patent is extended or adjusted under 35 U.S.C. 154(b) by 0 days.

(21) Appl. No.: 14/468,306

(22) Filed: Aug. 25, 2014

Related U.S. Application Data

(62) Division of application No. 13/588,348, filed on Aug. 17, 2012, now Pat. No. 8,852,038.

(51) Int. Cl.
*F42B 6/04* (2006.01)

(52) U.S. Cl.
CPC ..... *F42B 6/04* (2013.01)

(58) Field of Classification Search
CPC ..... F42B 6/04; F42B 6/06; F42B 6/08
See application file for complete search history.

(56) References Cited

U.S. PATENT DOCUMENTS

| | | | |
|---|---|---|---|
| 6,595,868 | B1 | 7/2003 | Androlia |
| 8,241,156 | B2 | 8/2012 | Sims et al. |
| 8,439,777 | B2 | 5/2013 | Pierce et al. |
| 2006/0014598 | A1 | 1/2006 | Martin |
| 2008/0085793 | A1 | 4/2008 | Palomaki et al. |

OTHER PUBLICATIONS

U.S. Appl. No. 13/588,348, filed Aug. 17, 2012, Hyde.
Office action dated Jan. 6, 2014 in parent U.S. Appl. No. 13/588,348.
Allowance dated May 29, 2014 in parent U.S. Appl. No. 13/588,348.

*Primary Examiner* — John Ricci
(74) *Attorney, Agent, or Firm* — David S. Alavi

(57) ABSTRACT

A shock-absorbing bolt for a crossbow comprises a shaft, a forward flange, and a shock-absorbing mechanism coupled to the shaft or the forward flange. The forward flange is coupled to a forward end of the shaft and has a forward surface with a transverse area that is greater than about three times larger than a transverse area of the shaft. A tapered tip can be attached to and protrude from the forward surface of the forward flange. The shock-absorbing mechanism is arranged so that, upon acceleration or deceleration of the bolt, kinetic energy of the bolt is dissipated by viscoelastic, viscous, or frictional forces within the bolt.

14 Claims, 14 Drawing Sheets

SHOCK-ABSORBING BOLT FOR A CROSSBOW

This application is a divisional of U.S. non-provisional application Ser. No. 13/588,348 filed Aug. 17, 2012 in the name of Tony E. Hyde, said application being hereby incorporated by reference as if fully set forth herein.

The field of the present invention relates to crossbows. In particular, a shock-absorbing bolt is disclosed for releasing safely the stored energy of a drawn crossbow.

BACKGROUND

A great deal of mechanical energy is stored in the deformed limbs of a drawn crossbow. That energy is applied to the crossbow by the mechanical work done by the archer when the crossbow is drawn. Some crossbows include a stirrup at the front end that is arranged to be placed on the ground and held down by the archer's foot while he or she pulls the bowstring. Other crossbows include one or more cranks, pulleys, levers, or other mechanical aids to draw the crossbow. In either case, once drawn, the bowstring is held in the drawn position by a hook, caliper, or other retainer until released by triggering the crossbow. The mechanical energy stored in the deformed limbs is converted (mostly) to kinetic energy of the bolt shot by the crossbow.

Once drawn, it is difficult to release the energy stored by the drawn crossbow without shooting the bolt. Releasing the drawn bowstring without a bolt in place is ill-advised; without the bolt to take up the pent-up energy of the drawn crossbow, that energy instead often results in damage to the crossbow or injury to the archer. Mechanical aides used for drawing the bowstring typically are not arranged to operate in reverse (i.e., to enable controlled "un-drawing" or "de-cocking" of the crossbow). If a safe area is available where the bolt can be fired, then the bolt can be shot by the crossbow into that area. However, that usually results in loss of the bolt due to the long range of the crossbow or damage to the bolt upon striking an obstruction (e.g., a tree or the ground).

SUMMARY

A shock-absorbing bolt for a crossbow comprises a shaft, a forward flange, and a shock-absorbing mechanism coupled to the shaft or the forward flange. The forward flange is coupled to a forward end of the shaft and has a forward surface with a transverse area that is greater than about three times larger than a transverse area of the shaft. A tapered tip can be attached to and protrude from the forward surface of the forward flange. The shock-absorbing mechanism is arranged so that, upon acceleration or deceleration of the bolt, kinetic energy of the bolt is dissipated by viscoelastic, viscous, or frictional forces within the bolt.

The shock-absorbing mechanism can include a viscoelastic member and at least one movable member. Acceleration or deceleration of the bolt results in movement of the movable member that deforms the viscoelastic member, thereby dissipating at least a portion of the kinetic energy of the bolt. Alternatively, the shock-absorbing mechanism can include a hollow cylinder, a piston reciprocally movable within the cylinder and dividing the cylinder into first and second chambers, a fluid in the first and second chambers, and one or more channels or orifices arranged to permit restricted fluid flow between the first and second chambers. Acceleration or deceleration of the bolt results in movement of the piston within the cylinder and concomitant viscous flow of the fluid between the first and second chambers through the one or more channels or orifices, thereby dissipating at least a portion of the kinetic energy of the bolt.

Objects and advantages pertaining to bolts for a crossbow may become apparent upon referring to the exemplary embodiments illustrated in the drawings and disclosed in the following written description or appended claims.

This summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

Figure 1:
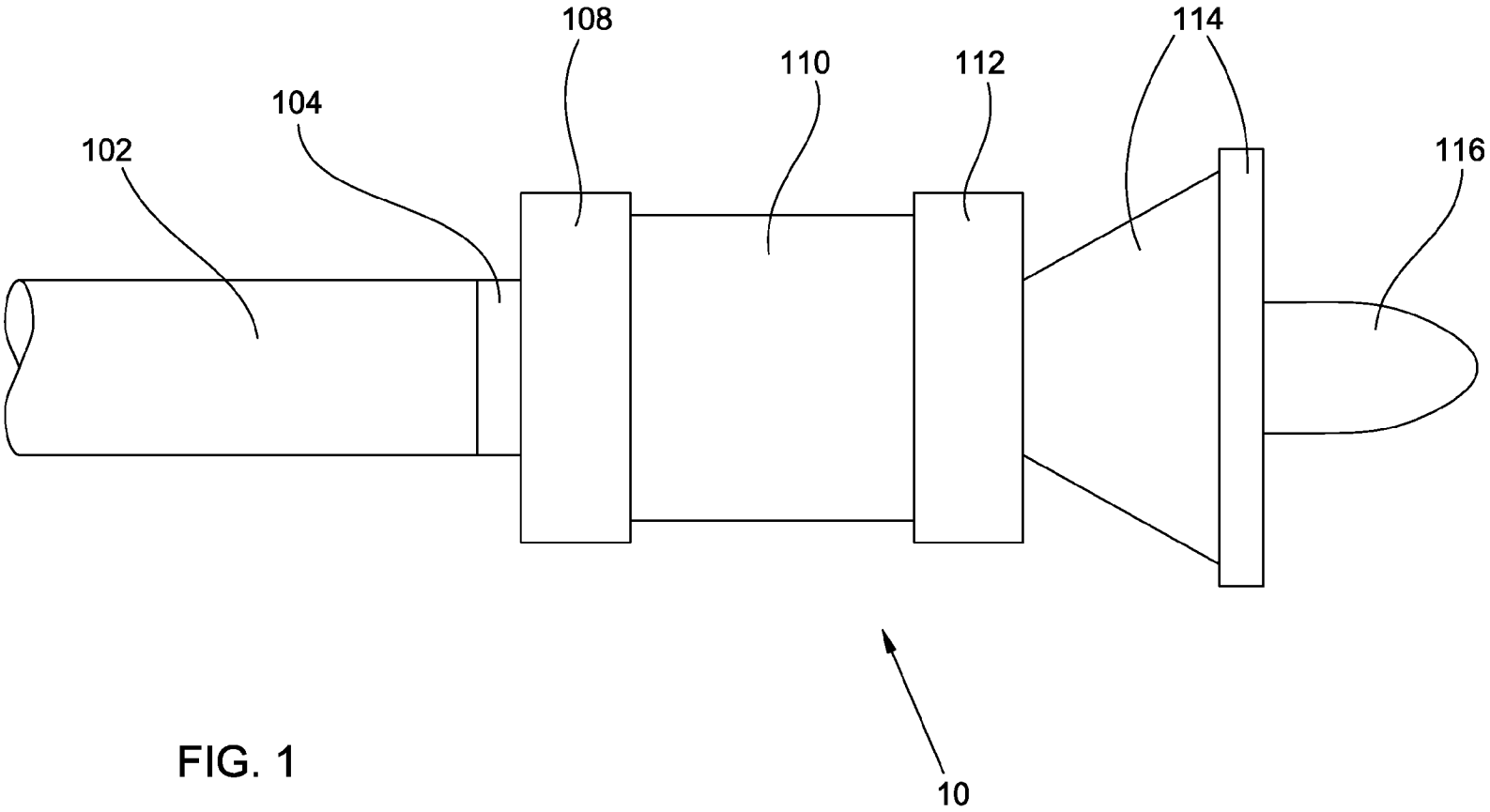
FIG. 1 is a side view of the front end of a first exemplary shock-absorbing bolt for a crossbow.

It should be noted that the embodiments depicted in this disclosure are shown only schematically, and that not all features may be shown in full detail or in proper proportion. Certain features or structures may be exaggerated relative to others for clarity. It should be noted further that the embodiments shown are exemplary only, and should not be construed as limiting the scope of the written description or appended claims.

DETAILED DESCRIPTION OF EMBODIMENTS

It would be desirable to provide a way to release the stored energy of a drawn crossbow without risking damage to the crossbow, injury to the archer, or loss of or damage to a bolt. A shock-absorbing bolt is disclosed herein that achieves that purpose. To release the energy of the drawn crossbow, the conventional bolt is removed and replaced with a shock-absorbing bolt as disclosed hereinbelow. The crossbow is then used to shoot the shock-absorbing bolt into the ground, a tree, a target, or into some other suitable object or surface. The shock-absorbing bolt is arranged so as to reduce penetration of the targeted object or surface and to reduce recoil or ricochet of the bolt upon impact with the targeted object or surface. The shock-absorbing bolt is intended to be used repeatedly in this way, and is preferably robustly constructed to withstand such repeated impacts.

A first exemplary embodiment of a shock-absorbing bolt 10 for a crossbow (FIGS. 1-6) comprises a rearward, outer shaft 102, a forward, inner shaft 106, a forward flange 114 with a tip 116, a forward washer 112 and a rearward washer 108, and a viscoelastic shock absorber 110. The outer shaft 102 is typically heavier and more rigid than a shaft of a conventional bolt in order to withstand the repeated impacts described above. Because there is no need to reduce or minimize the mass of the shaft (a significant design constraint for conventional bolts), the desired heavier, more rigid construction of the outer shaft 102 can be readily achieved. Any suitably rigid and durable material can be employed for the outer shaft 102; in some examples the outer shaft 102 can comprise aluminum, steel, stainless steel, other suitable metal, carbon fiber, fiberglass, graphite, or other suitably durable material. In addition to providing a more durable shaft, a greater mass of the shock-absorbing bolt 10 is generally desirable for reducing the velocity (and therefore range of flight) of the bolt for a given amount of energy imparted by the crossbow. An ordinary bolt for a crossbow typically has a mass between about 350 grains and about 600 grains; in contrast, the shock-absorbing bolt disclosed herein typically has a mass greater than about 1000 grains (including the mass of structures at the forward end of the bolt 10 described below).

The forward, inner shaft 106 is slidably received in a forward end of the outer shaft 102. The inner shaft 106 or the outer shaft 102 is arranged to limit forward movement of the inner shaft 106 relative to the outer shaft 102 and to retain a rearward portion of the inner shaft 106 within the forward end of the outer shaft 102. In the example shown, the inner shaft 106 includes a circumferential flange or ridge **106*a* at its rearward end. The outer shaft 102 comprises an insert 104 received and retained within the forward end of the outer shaft 102. The inner shaft 106 extends through and is slidable within the insert 104. The flange 106*a* (or other suitable retainer) is attached to a rearward end of the inner shaft 106 and is arranged to prevent entry of the retainer 106*a* into a rearward end of the insert 104, thereby limiting forward movement of the inner shaft 106 relative to the outer shaft 102. Any suitably arranged retainer can be employed for limiting forward movement of the inner shaft 106 relative to the outer shaft 102. Use of the insert 104 also enables ready replacement of the outer shaft 102; the outer shaft 102 tends to become damaged upon repeated use of the shock-absorbing bolt as described herein. Alternatively, the outer shaft 102 can be integrally formed to include a suitable arrangement (e.g., an internal circumferential ridge similar to the rearward end of the insert 104) for retaining the inner shaft 106**.

The front end of the shock-absorbing bolt 10 is adapted to (i) prevent excessive penetration of the bolt 10 in the ground, tree, target, or other object or surface into which it is shot, and (ii) to reduce recoil or ricochet of the bolt 10 upon impact with the targeted object or surface. To prevent excessive penetration of the targeted object or surface, the bolt 10 includes a forward flange 114 attached to a forward end of the inner shaft 106. The forward flange 114 has a forward surface with a transverse area that is about three times (or more) larger the than a transverse area of the outer shaft 102. A tapered tip 116 can be attached to and protrude from the forward surface of the forward flange 114; in some embodiments the tip 116 can be integrally formed with the forward flange 114. The tip 116 need not be sharp like an ordinary head or tip of a conventional arrow or bolt; typically it can be somewhat blunt. The tip 116 (if present) serves to penetrate only a limited distance into, e.g., the ground when the bolt 10 is shot; that limited penetration serves to limit further travel of the bolt after it hits the ground or other surface (by recoil or ricochet), but is short enough to enable relatively easy removal of the bolt 10 from whatever surface into which tip 116 has penetrated. The enlarged transverse area of the forward surface of the forward flange 114 prevents further penetration of the shock-absorbing bolt 10 into the ground or other targeted surface or object. The forward flange 114 can comprise metal (e.g., aluminum, steel, stainless steel, or other metal) or other material that is sufficiently durable to withstand repeated impacts with the ground or other targeted surface or object without losing its structural integrity (surface marring is of no particular consequence). The mass of the forward flange 114 contributes to the overall mass of the bolt 10.

The rearward washer 108 is slidable along the inner shaft 106 with the shaft 106 passing through a hole in the rearward washer 108. The outer shaft 102 (or insert 104 thereof, if present) limits rearward movement of the rearward washer 108 along the inner shaft 106. The forward washer 112 is positioned between the forward flange 114 and the rearward washer 108. In some embodiments the forward washer 112 is fixed to the inner shaft 106 or to the forward flange 114 so as to substantially prevent movement of the forward washer 112 along the inner shaft 106; in some of those embodiments the forward washer 112 can be integrally formed with the forward flange 114 or the inner shaft 106. In some other embodiments the forward washer 112 is slidable along the inner shaft 106 with the shaft 106 passing through a hole in the forward washer 112; in those embodiments the forward flange 114 limits forward movement of the forward washer 112 along the inner shaft 106. The washers 108 and 112 can comprise metal (e.g., aluminum, steel, stainless steel, or other metal); other suitably rigid material can be employed. The masses of the forward washer 112 and the rearward washer 108 contribute to the overall mass of the bolt 10.

The viscoelastic shock absorber 110 is slidable along the inner shaft 106 between the forward washer 112 and the rearward washer 108. The inner shaft 106 passes through a hole in the shock absorber 110. Examples of suitable viscoelastic polymers include but are not limited to polyurethane polymers such as Sorbothane® viscoelastic polymer (as disclosed in U.S. Pat. Nos. 4,101,704 and 4,346,205 to Hiles, both of which patents are hereby incorporated by reference as if fully set forth herein); other suitable natural or synthetic viscoelastic polymers can be employed, e.g., butyl rubber. The mass of the viscoelastic shock absorber 110 contributes to the overall mass of the bolt 10.

Figure 6:
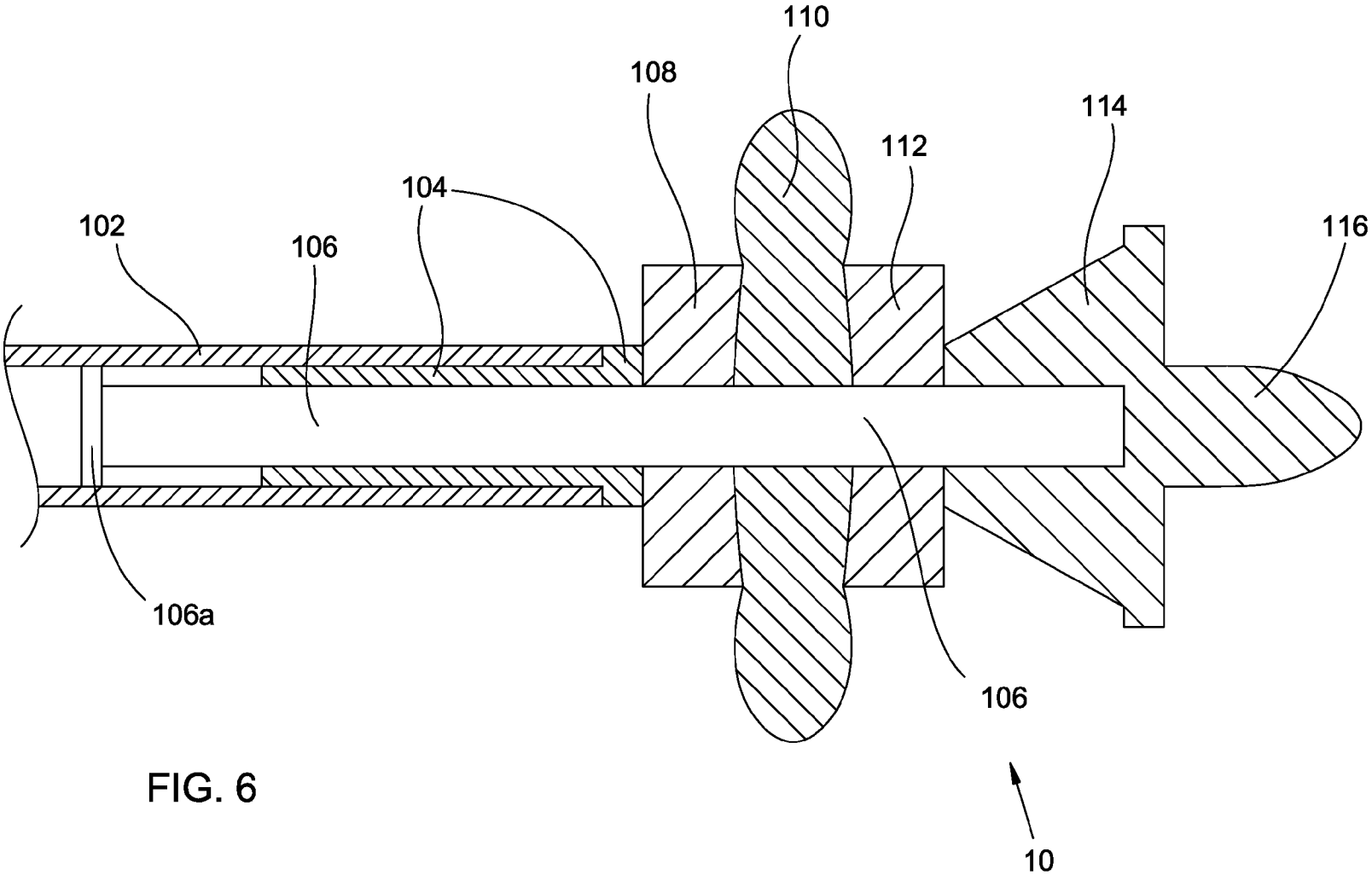
FIG. 6 is a side cross-section of the shock-absorbing bolt of FIG. 1 as it decelerates upon impact.
Figure 7:
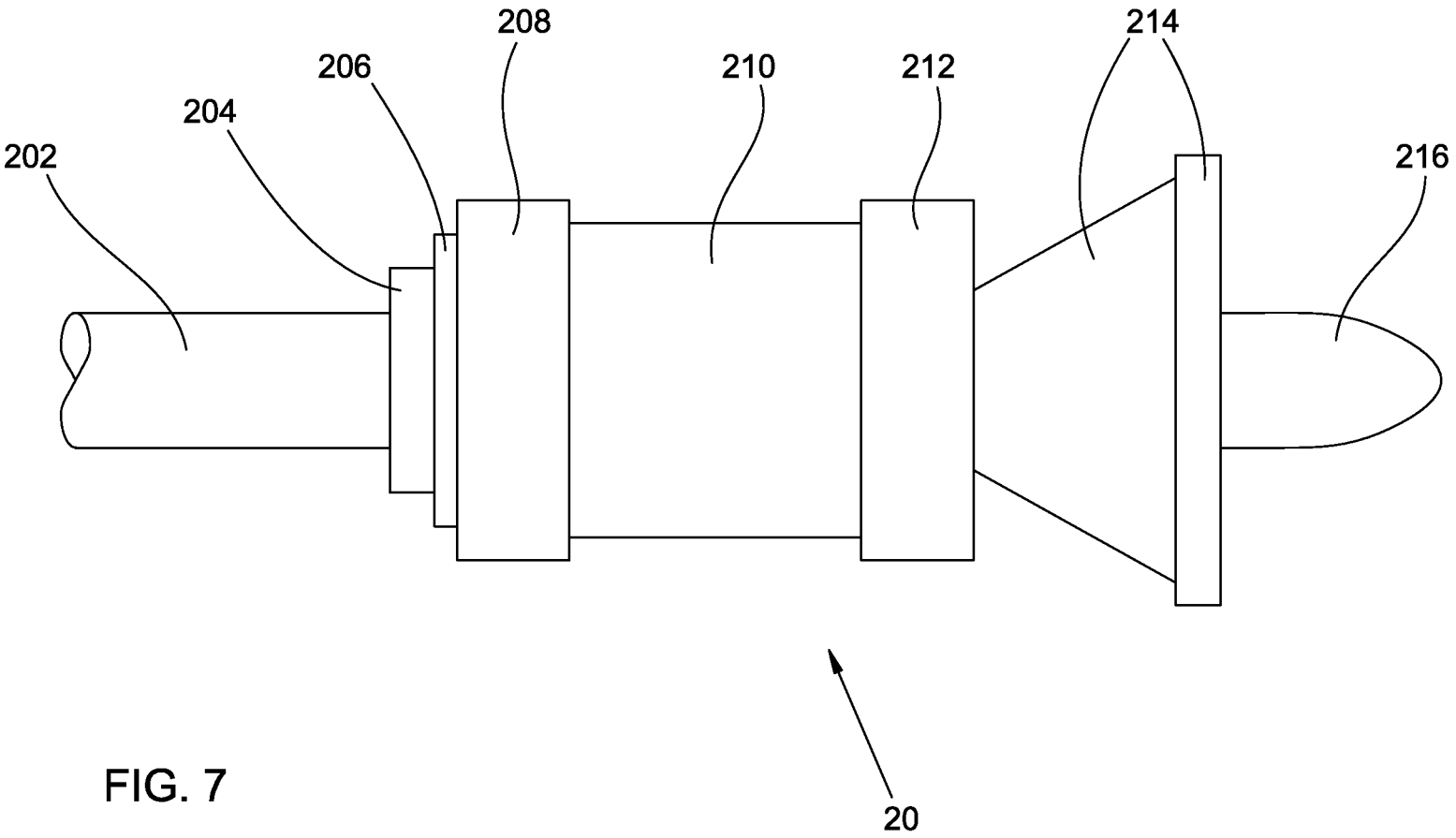
FIG. 7 is a side view of the front end of a second exemplary shock-absorbing bolt for a crossbow.
Figure 8:
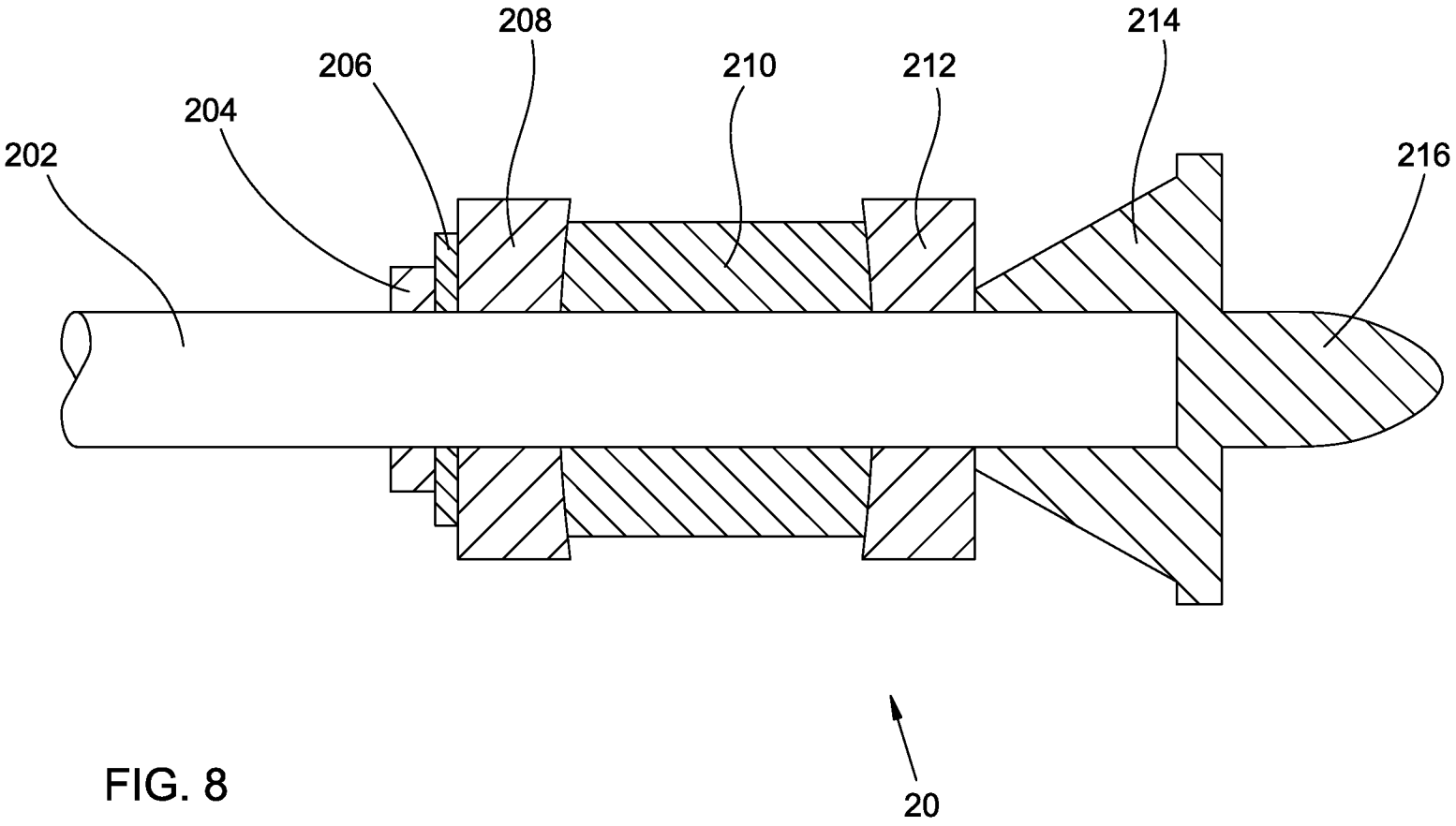
FIG. 8 is a side cross-section of the shock-absorbing bolt of FIG. 7.
Figure 9:
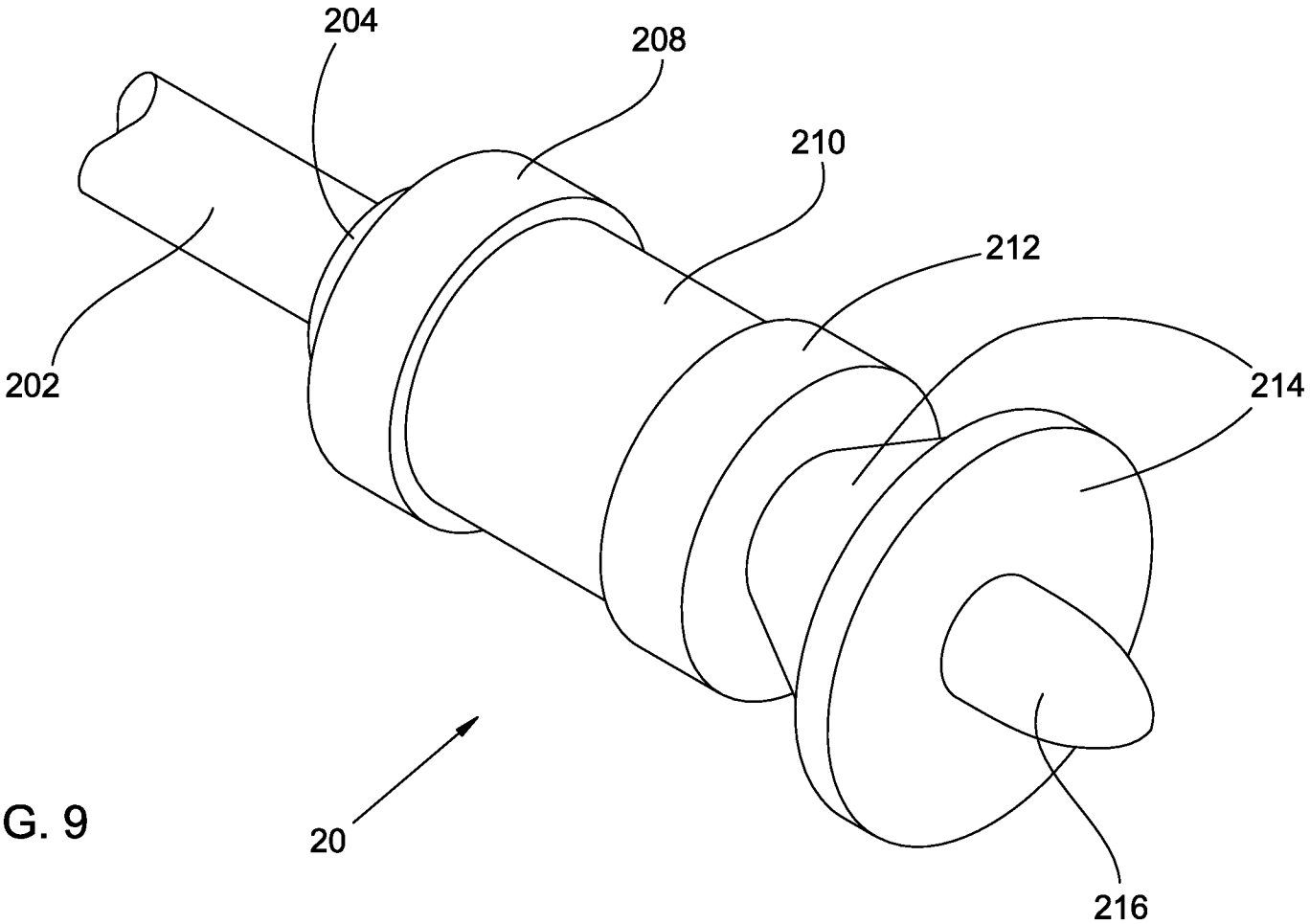
FIG. 9 is a front isometric view of the shock-absorbing bolt of FIG. 7.
Figure 10:
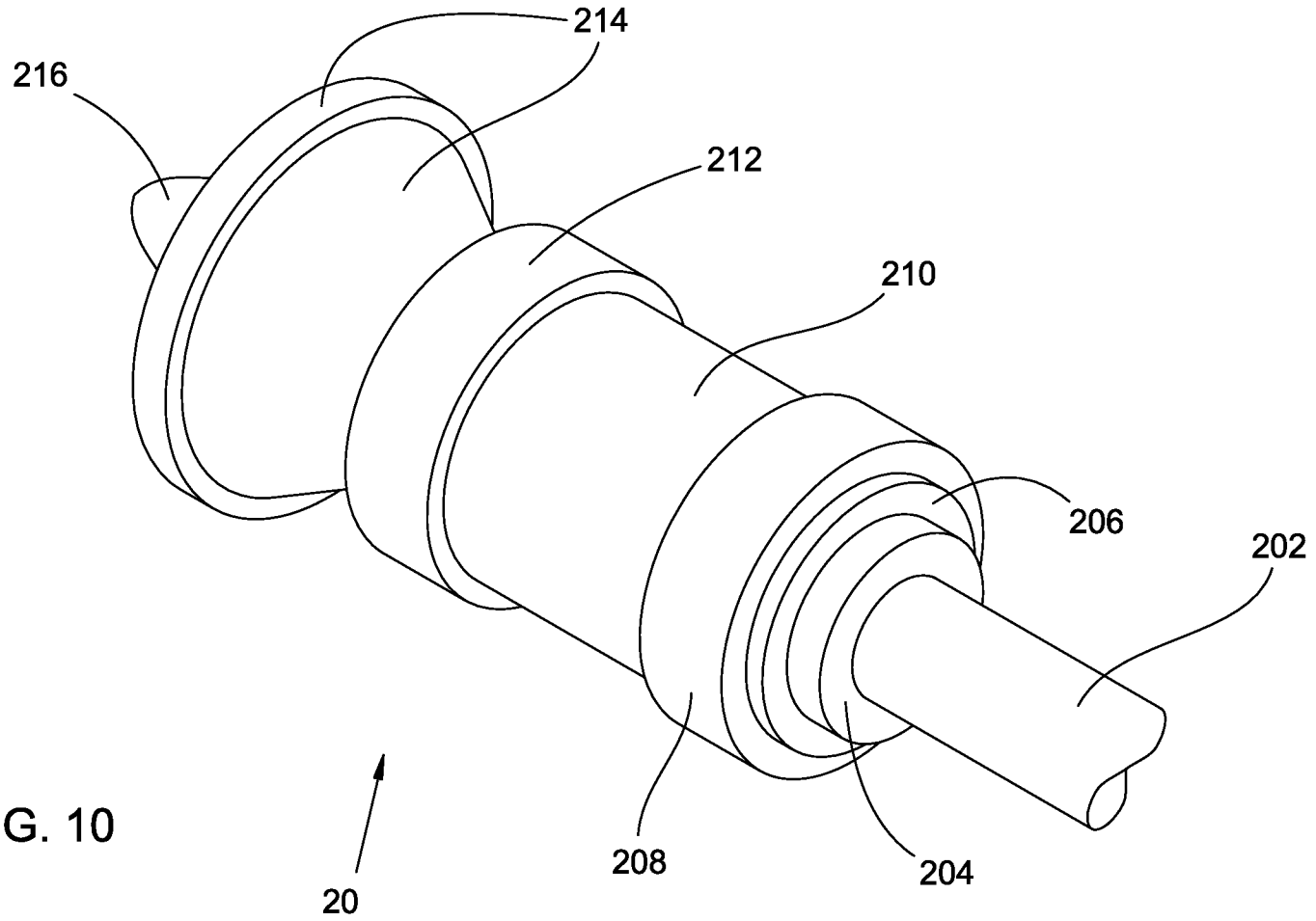
FIG. 10 is a rear isometric view of the shock-absorbing bolt of FIG. 7.
Figure 11A:
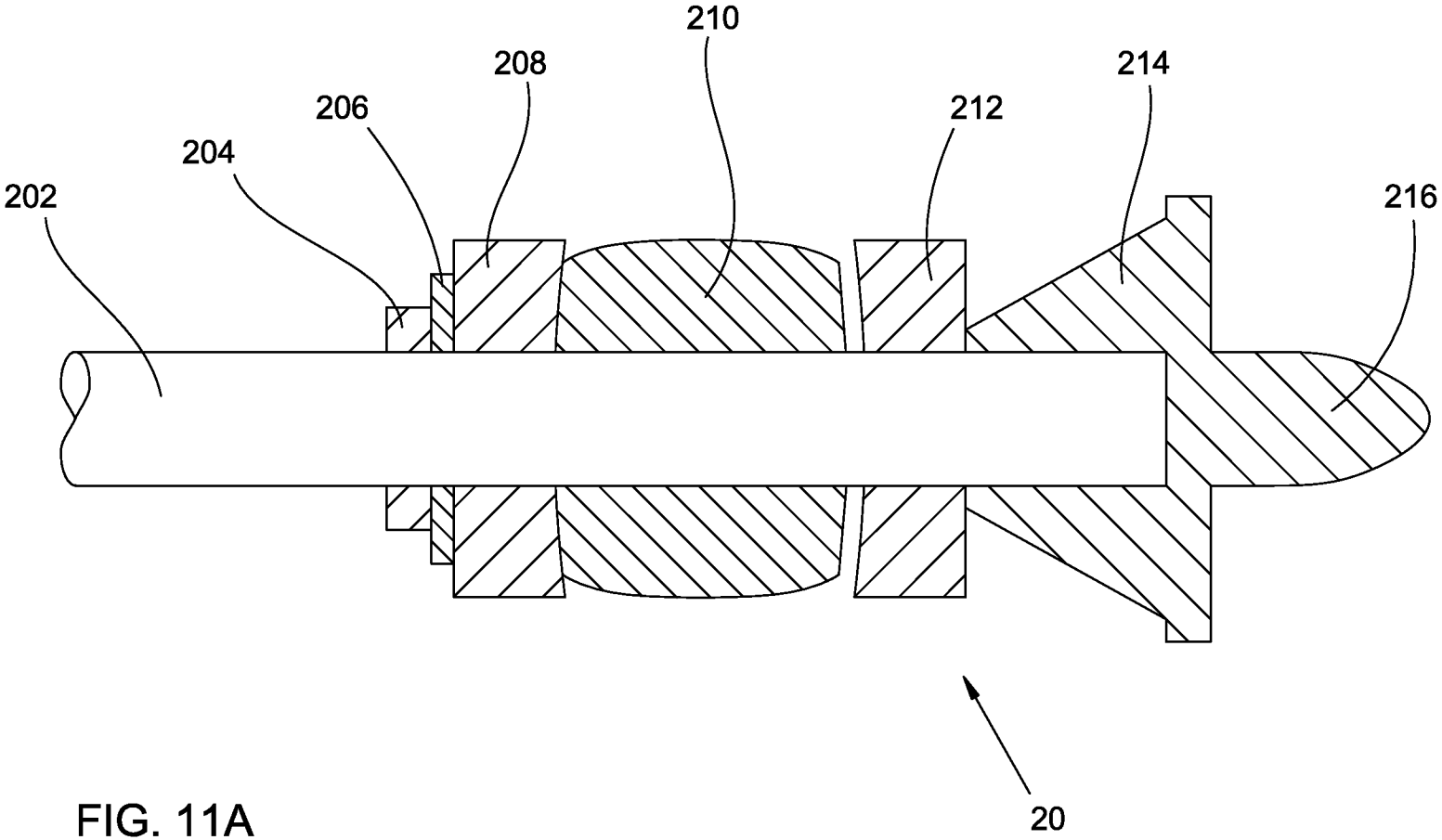
FIGS. 11A and 11B are side cross-sections of two embodiments of the shock-absorbing bolt of FIG. 7 as it accelerates forward upon being launched by a crossbow.
Figure 11B:
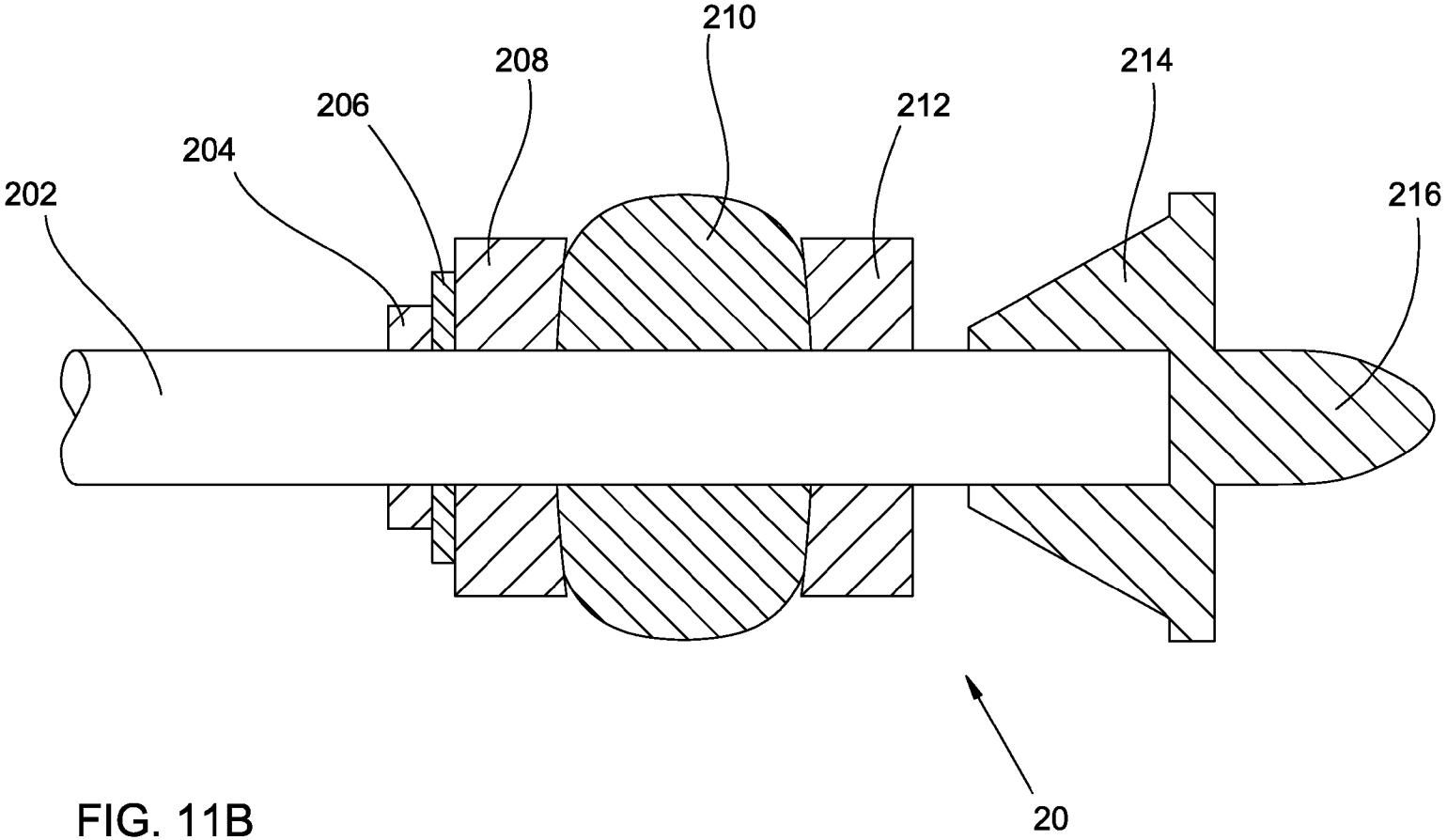

After being shot and upon impact with the ground, a tree, or another suitable surface or object, the bolt 10 abruptly decelerates to near zero forward velocity. The inertia of the outer shaft 102 and the rearward washer 108 causes them to continue moving forward along the inner shaft 106. The presence of the forward flange 114 limits forward movement of the forward washer 112 (if it is in fact movable). The forward movement of the rearward washer 108 causes longitudinal compression of the viscoelastic shock absorber 110 between the forward washer 112 and the rearward washer 108 (as in FIG. 6). Longitudinal compression of the viscoelastic shock absorber 110 typically also causes transverse expansion thereof (FIG. 6). The longitudinally compressed viscoelastic shock absorber 110 eventually recovers its original shape, causing rearward movement of the rearward washer 108 and the outer shaft 102. The compression and re-expansion of the viscoelastic shock absorber 110 dissipates a significant fraction of the kinetic energy of the bolt and reduces the energy available for recoil or ricochet of the bolt 10 after its initial impact. The retainer 106*a* limits the rearward movement of the rearward washer 108 and the outer shaft 102 as the viscoelastic shock absorber 110 rebounds.

Figure 2:
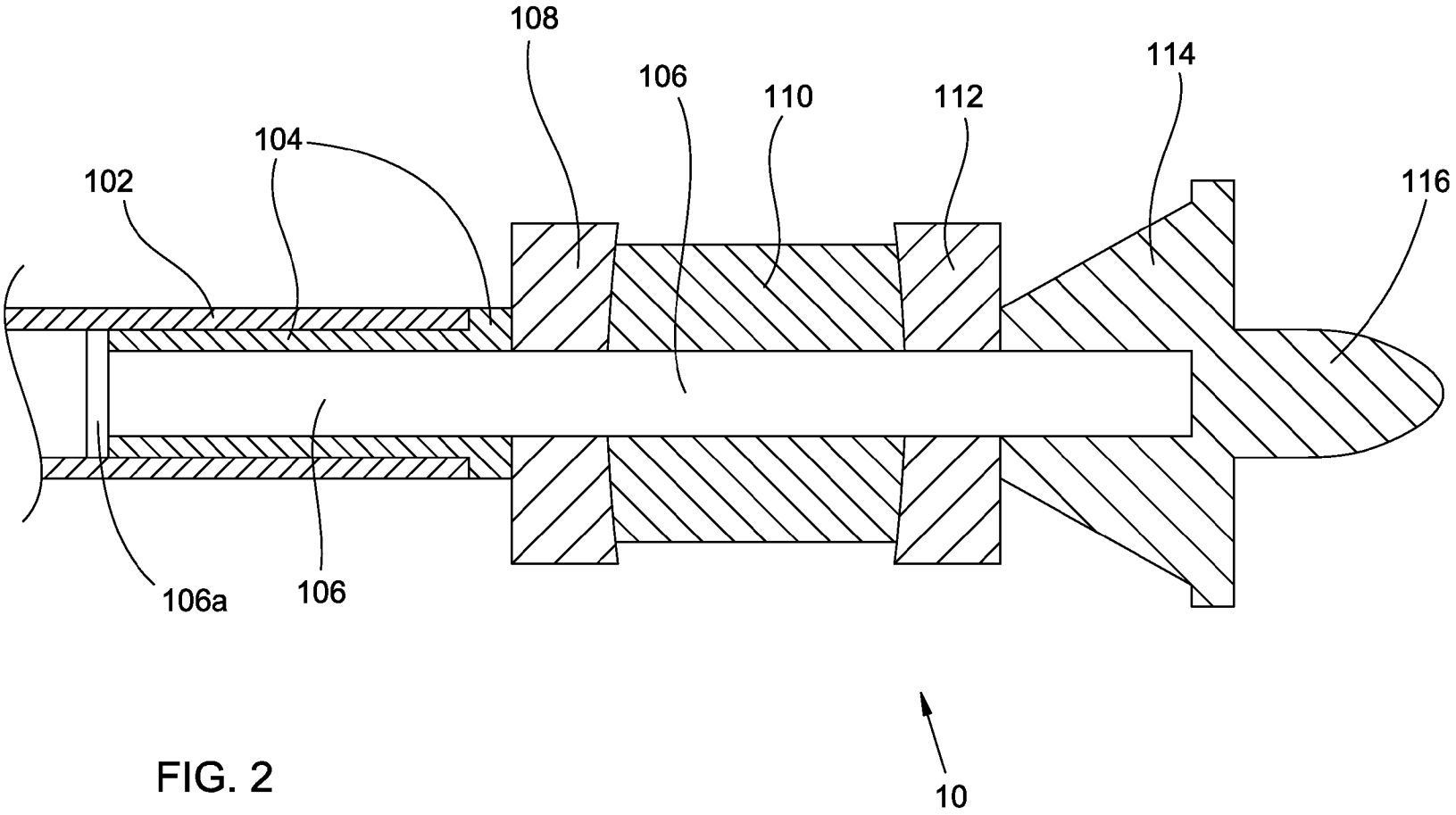
FIG. 2 is a side cross-section of the shock-absorbing bolt of FIG. 1.
Figure 3:
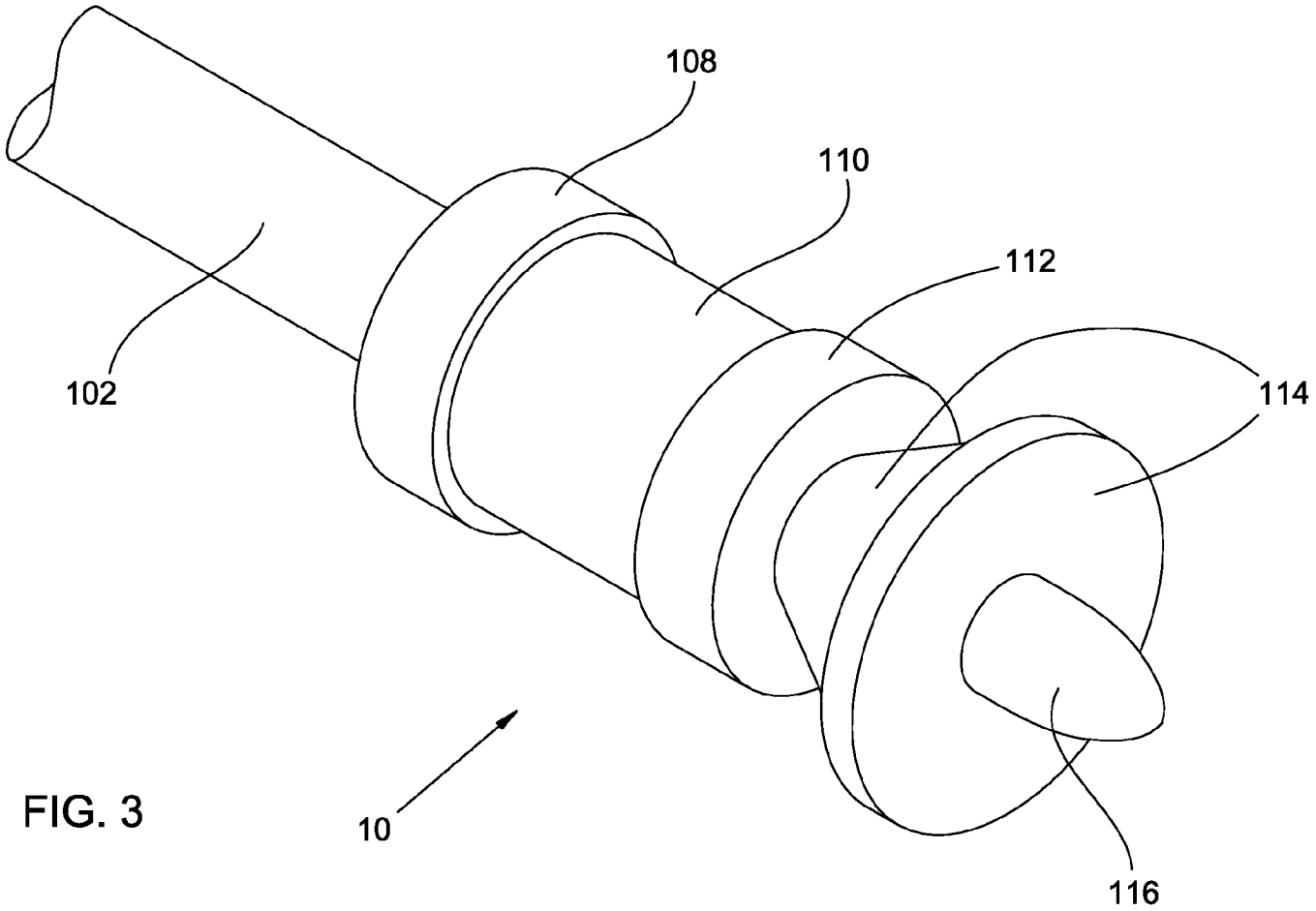
FIG. 3 is a front isometric view of the shock-absorbing bolt of FIG. 1.
Figure 4:
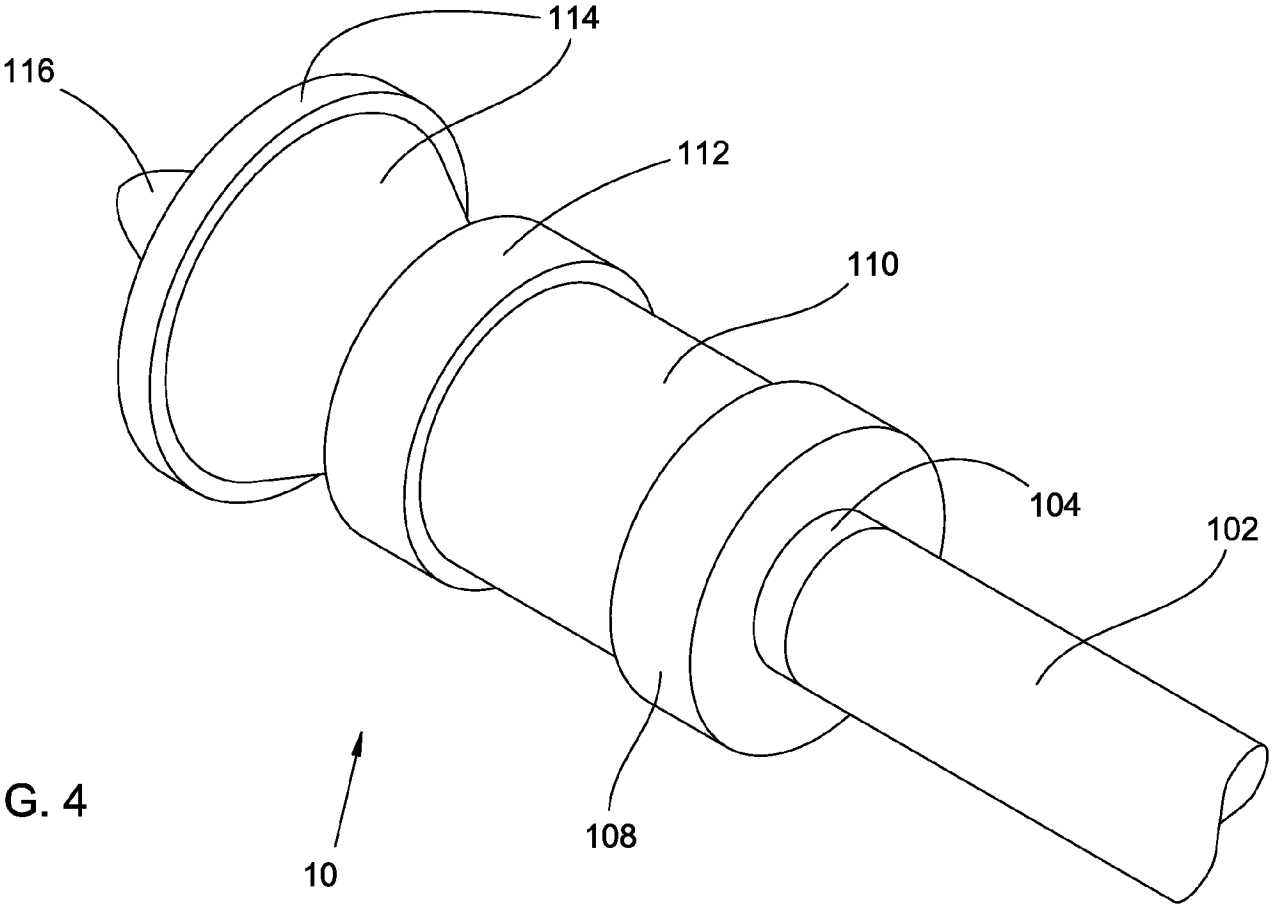
FIG. 4 is a rear isometric view of the shock-absorbing bolt of FIG. 1.
Figure 5:
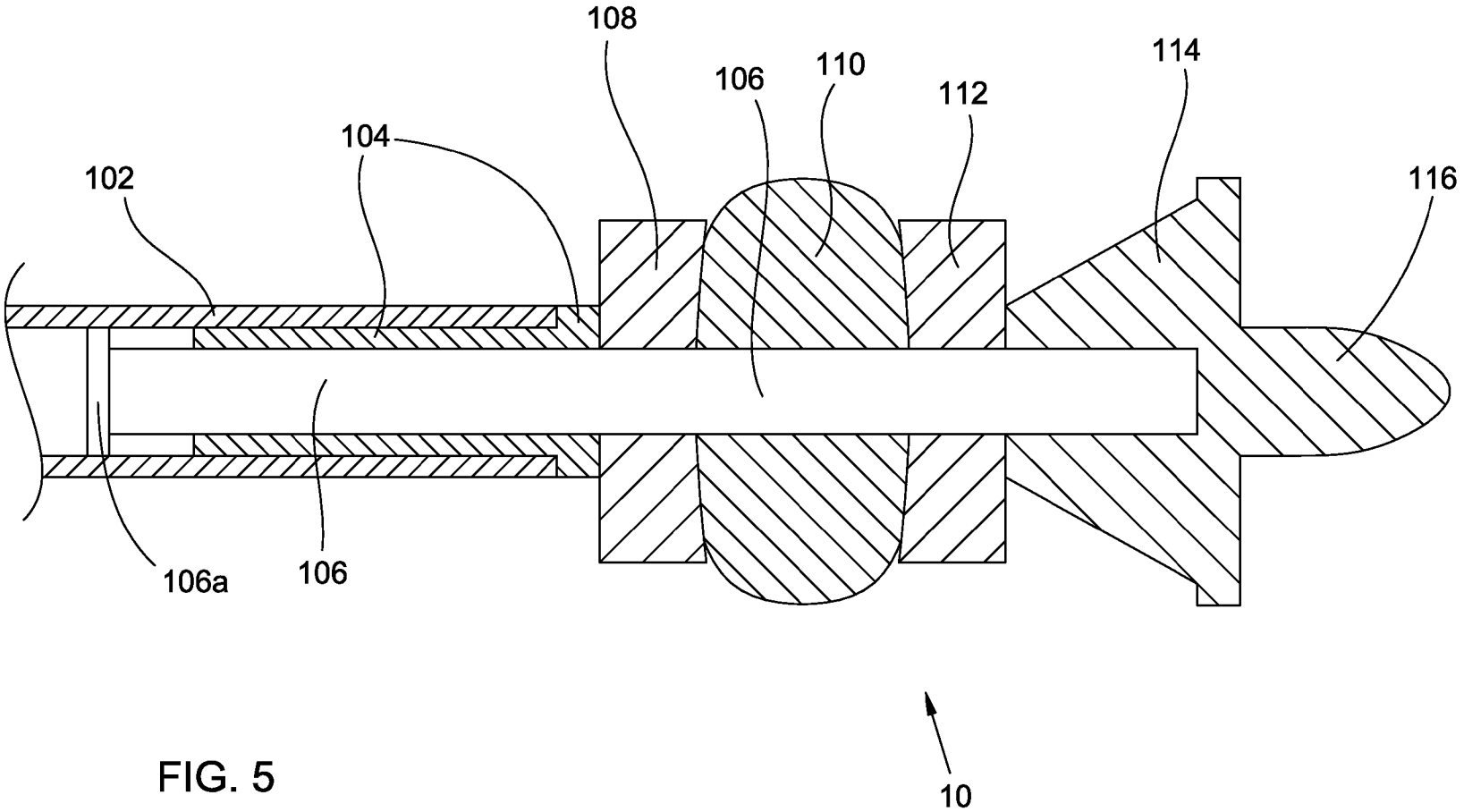
FIG. 5 is a side cross-section of the shock-absorbing bolt of FIG. 1 as it accelerates forward upon being launched by a crossbow.

In some embodiments, a rearward surface of the forward washer 112 is concave and a forward surface of the rearward washer 108 is concave (as in FIGS. 2, 5, and 6). Those concave washer surfaces are arranged to limit transverse expansion of the shock absorber 110 as it is longitudinally compressed between the forward and rearward washers 112 and 108 upon their relative movement toward one another along the inner shaft 106. Without those concave washer surfaces, in some instances the excessive kinetic energy of the bolt 10 can result in transverse deformation of the shock absorber so extreme that, upon impact, the rearward washer 108 can sometimes pass through the hole in the shock absorber 110, often damaging the shock absorber 110 and sometimes damaging the bolt 10. The concavity of the washer surfaces in contact with the shock absorber 110 tends to limit that transverse deformation and prevent passage of the rearward washer 108 through the shock absorber 110.

When the bolt 10 is shot from the crossbow, it is rapidly accelerated in the forward direction. The forward acceleration of the bolt 10 (by force applied directly to the outer shaft 102 and transmitted to the rearward washer 108 and the shock absorber 110) tends to longitudinally compress the viscoelastic shock absorber 110, due to the inertia of the forward flange 114, the tip 116, the forward washer 112, and the inner shaft 106 (FIG. 5). In some instances the shock absorber 110 can rebound to its relaxed state (as in FIG. 2) before being compressed again by impact with the ground or other surface or object (as in FIG. 6; described above). The compression and relaxation of the viscoelastic shock absorber 110 during acceleration of the bolt 10 can serve to dissipate some of the stored energy of the drawn crossbow.

A second exemplary embodiment of a shock-absorbing bolt 20 for a crossbow (FIGS. 7-12) comprises a shaft 202, a forward flange 214 with a tip 216, a forward washer 212 and a rearward washer 208, a viscoelastic shock absorber 210, and a retainer 204. As noted above, the shaft 202 is typically heavier and more rigid than that of a conventional bolt. The shaft can comprise the same materials disclosed above. The second exemplary embodiment can advantageously exhibit increased mass relative to an ordinary bolt, as discussed above.

As with the first exemplary embodiment, the front end of the shock-absorbing bolt 20 is adapted to (i) prevent excessive penetration of the bolt 20 in the ground, tree, target, or other object or surface into which it is shot, and (ii) to reduce recoil or ricochet of the bolt 20 upon impact with the targeted object or surface. The forward flange 214 is attached to a forward end of the shaft 202, and the forward flange and tapered tip 216 are otherwise arranged as described above.

The rearward washer 208 is slidable along the shaft 202 with the shaft 202 passing through a hole in the rearward washer 208. The retainer 204 is attached to the shaft 202 and positioned to limit rearward movement of the rearward washer 208 along the shaft 202; the retainer can comprise any suitably arranged transverse or circumferential ridge, flange, or stop connected to, integrally formed on, or otherwise attached to the shaft 202. The forward washer 212 is positioned between the forward flange 214 and the rearward washer 208. In some embodiments the forward washer is fixed to the shaft 202 or to the forward flange 214 so as to substantially prevent movement of the forward washer 212 along the shaft 202; in some of those embodiments the forward washer 212 can be integrally formed with the forward flange 214 or the shaft 202. In some other embodiments the forward washer 212 is slidable along the shaft 202 with the shaft 202 passing through a hole in the forward washer 212; in those embodiments the forward flange 214 limits forward movement of the forward washer 212 along the shaft 202. The washers 208 and 212 can comprise any of the materials disclosed above. The masses of the forward washer 212 and the rearward washer 208 contribute to the overall mass of the bolt 20.

The viscoelastic shock absorber 210 is slidable along the shaft 202 between the forward washer 212 and the rearward washer 208. The shaft 202 passes through a hole in the shock absorber 210. Examples of suitable viscoelastic polymers are disclosed above. The mass of the viscoelastic shock absorber 210 contributes to the overall mass of the bolt 20.

Figure 12:
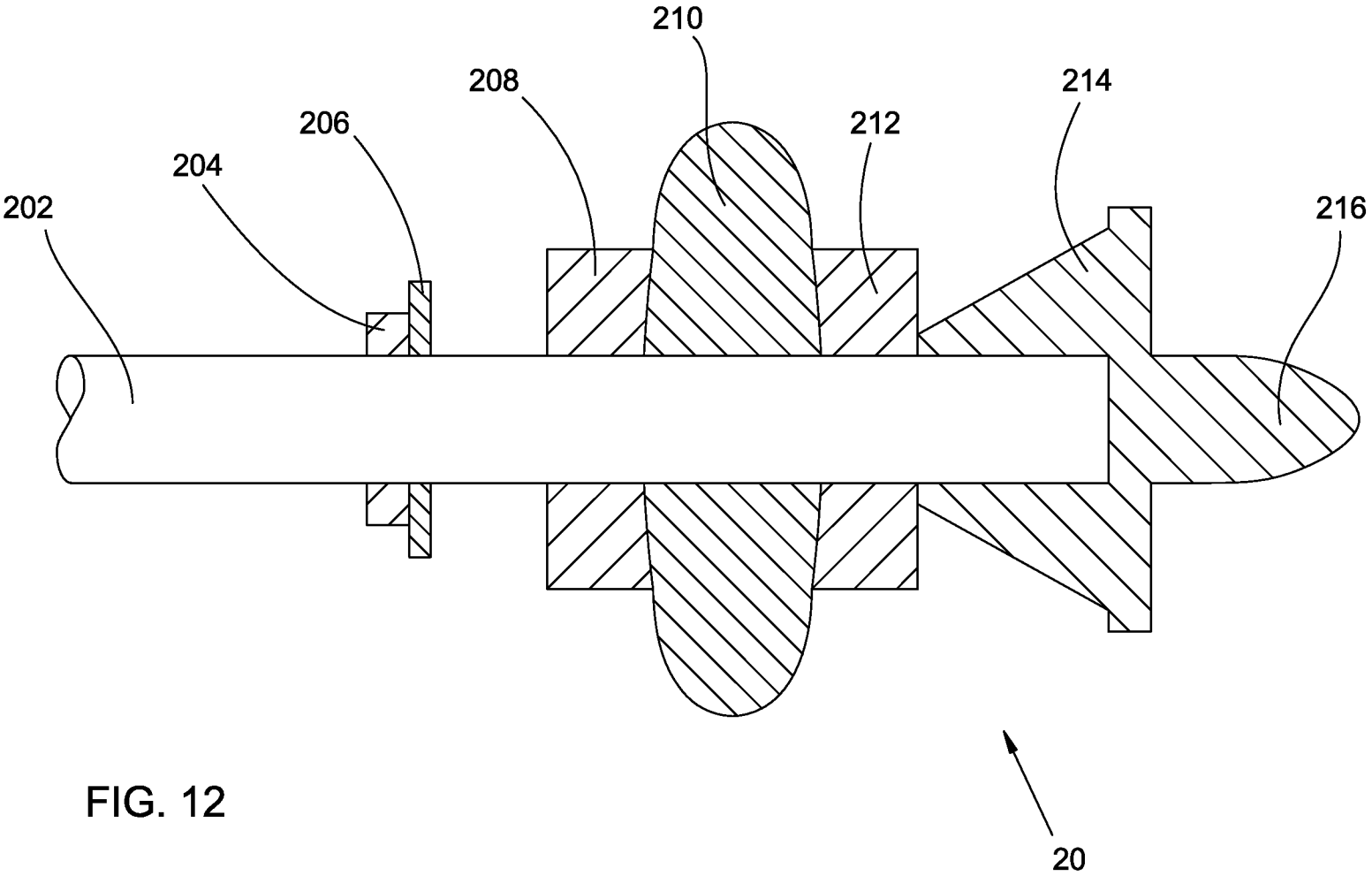
FIG. 12 is a side cross-section of the shock-absorbing bolt of FIG. 7 as it decelerates upon impact.

After being shot and upon impact with the ground, a tree, or another suitable surface or object, the bolt 20 abruptly decelerates to near zero forward velocity. The inertia of the rearward washer 208 causes the rearward washer 208 to continue moving forward along the shaft 202. The presence of the forward flange 214 limits forward movement of the forward washer 212. The forward movement of the rearward washer 208 causes longitudinal compression of the viscoelastic shock absorber 210 between the forward washer 212 and the rearward washer 208 (as in FIG. 12). Longitudinal compression of the viscoelastic shock absorber 210 typically also causes transverse expansion thereof (FIG. 12). The longitudinally compressed viscoelastic shock absorber 210 eventually recovers its original shape, causing rearward movement of the rearward washer 208. The compression and re-expansion of the viscoelastic shock absorber 210 dissipates a significant fraction of the kinetic energy of the bolt and reduces the energy available for recoil or ricochet of the bolt 20 after its initial impact. The retainer 204 limits the rearward movement of the rearward washer 208 as the viscoelastic shock absorber rebounds. An elastomeric washer 206 can be positioned between the retainer 204 and the rearward washer 208; the elastomeric washer 206 can comprise the same viscoelastic material as the shock absorber 210 or can comprise a different elastic or viscoelastic material.

In some embodiments, a rearward surface of the forward washer 212 is concave and a forward surface of the rearward washer 208 is concave (as in FIGS. 8, 11A, 11B, and 12). Those concave washer surfaces are arranged to limit transverse expansion of the shock absorber 210 as it is longitudinally compressed between the forward and rearward washers 212 and 208 upon their relative movement toward one another along the shaft 202, for the reasons discussed above.

When the bolt 20 is shot from the crossbow, it is rapidly accelerated in the forward direction. The retainer 204 is attached to the shaft 202 so as to limit rearward motion of the rearward washer 208 along the shaft 202 during that rapid acceleration. Compression and relaxation of elastomeric washer 206 (if present) can serve to dissipate some of the energy released from the drawn crossbow. The forward acceleration of the bolt 20 also tends to longitudinally compress the viscoelastic shock absorber 210. In embodiments wherein the forward washer 212 is not movable along the shaft 202, the shock absorber's own inertia can compress it longitudinally (as in FIG. 11A). In embodiments wherein the forward washer 212 is slidable along the shaft 202, the inertia of the forward washer 212 causes it to slide rearward along the shaft 202, causing the shock absorber 210 to be compressed between the forward and rearward washers 212 and 208 (as in FIG. 11B). In either case, the viscoelastic shock absorber 210 can in some instances rebound to its relaxed state (as in FIG. 8) before being compressed again by impact with the ground or other surface or object (as in FIG. 12; described above). The compression and relaxation of the viscoelastic shock absorber 210 during acceleration of the bolt 20 can serve to dissipate some of the stored energy of the drawn crossbow.

Figure 13:
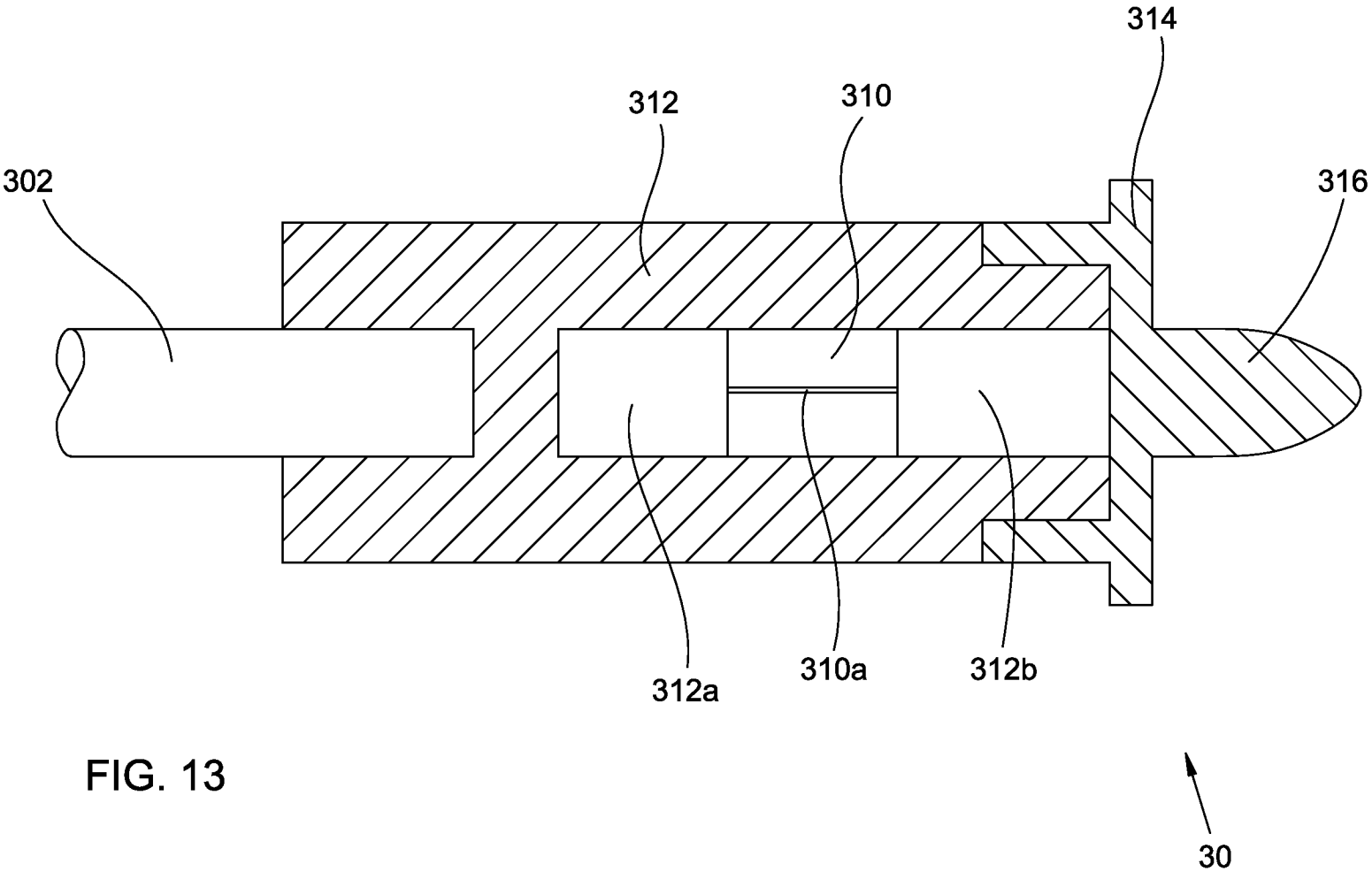
FIG. 13 is a side cross-section of a third exemplary shock-absorbing bolt for a crossbow.

A third exemplary embodiment of a shock-absorbing bolt 30 for a crossbow (FIG. 13) comprises a shaft 302, a forward flange 314 with a tip 316, a cylinder 312, and a piston 310. The piston 310 is reciprocally movable within the cylinder 312 and divides the cylinder 312 into chambers 312*a* and 312*b*. A narrow channel or orifice 310*a* through the piston 310 restricts fluid flow between the chambers 312*a* and 312*b*. Alternatively, a passage or orifice connecting chambers 312*a* and 312*b* can be provided in body of the cylinder 312. Movement of the piston 310 within the cylinder 312 forces fluid flow through the channel 310*a* between the chambers 312*a* and 312*b*. Any suitable gaseous or liquid fluid can be used to fill the chambers 312*a* and 312*b*, such as air, nitrogen, inert or noble gas, oil, or hydraulic fluid. Upon acceleration (e.g., upon launching the bolt 30 with the crossbow) or deceleration (e.g., upon impact), the inertia of the piston causes it to move within the cylinder 312, forcing viscous flow of fluid between the chambers 312*a* and 312*b* through the passage 310*a*. That viscous fluid flow dissipates at least a portion of the kinetic energy of the bolt 30.

It is intended that equivalents of the disclosed exemplary embodiments and methods shall fall within the scope of the present disclosure or appended claims. It is intended that the disclosed exemplary embodiments and methods, and equivalents thereof, may be modified while remaining within the scope of the present disclosure or appended claims.

In the foregoing Detailed Description, various features may be grouped together in several exemplary embodiments for the purpose of streamlining the disclosure. This method of disclosure is not to be interpreted as reflecting an intention that any claimed embodiment requires more features than are expressly recited in the corresponding claim. Rather, as the appended claims reflect, inventive subject matter may lie in less than all features of a single disclosed exemplary embodiment. Thus, the appended claims are hereby incorporated into the Detailed Description, with each claim standing on its own as a separate disclosed embodiment. However, the present disclosure shall also be construed as implicitly disclosing any embodiment having any suitable set of one or more disclosed or claimed features (i.e., sets of features that are not incompatible or mutually exclusive) that appear in the present disclosure or the appended claims, including those sets that may not be explicitly disclosed herein. It should be further noted that the scope of the appended claims do not necessarily encompass the whole of the subject matter disclosed herein.

For purposes of the present disclosure and appended claims, the conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or," "only one of," or similar language; or (ii) two or more of the listed alternatives are mutually exclusive within the particular context, in which case "or" would encompass only those combinations involving non-mutually-exclusive alternatives. For purposes of the present disclosure or appended claims, the words "comprising," "including," "having," and variants thereof, wherever they appear, shall be construed as open ended terminology, with the same meaning as if the phrase "at least" were appended after each instance thereof.

In the appended claims, if the provisions of 35 USC §112 ¶6 are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC §112 ¶6 are not intended to be invoked for that claim.

If any one or more disclosures are incorporated herein by reference and such incorporated disclosures conflict in part or whole with, or differ in scope from, the present disclosure, then to the extent of conflict, broader disclosure, or broader definition of terms, the present disclosure controls. If such incorporated disclosures conflict in part or whole with one another, then to the extent of conflict, the later-dated disclosure controls.

The Abstract is provided as required as an aid to those searching for specific subject matter within the patent literature. However, the Abstract is not intended to imply that any elements, features, or limitations recited therein are necessarily encompassed by any particular claim. The scope of subject matter encompassed by each claim shall be determined by the recitation of only that claim.

What is claimed is:

1. An article comprising a shock-absorbing bolt for a crossbow, wherein the shock-absorbing bolt comprises:

(a) a shaft;

(b) a forward flange coupled to a forward end of the shaft, which forward flange has a forward surface with a transverse area that is greater than about three times larger than a transverse area of the shaft; and (c) a shock-absorbing mechanism comprising a hollow cylinder, a piston reciprocally movable within the cylinder and dividing the cylinder into first and second chambers, a fluid in the first and second chambers, and one or more channels or orifices arranged to permit restricted fluid flow between the first and second chambers;

wherein:

(d) the shock-absorbing mechanism is coupled to the shaft or the forward flange, and (e) the shock-absorbing mechanism is arranged so that acceleration or deceleration of the bolt results in movement of the piston within the cylinder and concomitant viscous flow of the fluid between the first and second chambers through the one or more channels or orifices, thereby dissipating at least a portion of the kinetic energy of the bolt.

2. The article of claim 1 wherein the forward flange comprises a structurally durable material.

3. The article of claim 1 wherein the forward flange comprises metal.

4. The article of claim 1 wherein mass of the bolt is greater than about 1000 grains.

5. The article of claim 1 wherein one or more of the channels or orifices are formed through the piston or through a body of the cylinder.

6. A method comprising:

(a) loading a shock-absorbing bolt onto a drawn crossbow; and (b) shooting the crossbow to launch the shock-absorbing bolt toward a ground surface, a tree, or a target to release safely energy stored by the drawn crossbow, (c) wherein the shock-absorbing bolt comprises (i) a shaft, (ii) a forward flange coupled to a forward end of the shaft, which forward flange comprises a structurally durable material and has a forward surface with a transverse area that is greater than about three times larger than a transverse area of the shaft, (iii) a tapered tip attached to and protruding from the forward surface of the forward flange, and (iv) a shock-absorbing mechanism coupled to the shaft or the forward flange, which mechanism is arranged so that, upon acceleration or deceleration of the bolt, kinetic energy of the bolt is dissipated by viscoelastic, viscous, or frictional forces within the bolt.

7. The method of claim 6 wherein the forward flange comprises metal.

8. The method of claim 6 wherein mass of the bolt is greater than about 1000 grains.

9. A method comprising:

(a) loading a shock-absorbing bolt onto a drawn crossbow; and (b) shooting the crossbow to launch the shock-absorbing bolt toward a ground surface, a tree, or a target to release safely energy stored by the drawn crossbow, wherein:

(c) the shock-absorbing bolt comprises (i) a shaft, (ii) a forward flange coupled to a forward end of the shaft, which forward flange comprises a structurally durable material and has a forward surface with a transverse area that is greater than about three times larger than a transverse area of the shaft, and (iii) a shock-absorbing mechanism coupled to the shaft or the forward flange, which mechanism is arranged so that, upon acceleration or deceleration of the bolt, kinetic energy of the bolt is dissipated by viscoelastic, viscous, or frictional forces within the bolt;

(d) the shock-absorbing mechanism includes a hollow cylinder, a piston reciprocally movable within the cylinder and dividing the cylinder into first and second chambers, a fluid in the first and second chambers, and one or more channels or orifices arranged to permit restricted fluid flow between the first and second chambers; and (e) the shock-absorbing mechanism is arranged so that acceleration or deceleration of the bolt results in movement of the piston within the cylinder and concomitant viscous flow of the fluid between the first and second chambers through the one or more channels or orifices, thereby dissipating at least a portion of the kinetic energy of the bolt.

10. The method of claim 9 wherein the forward flange comprises metal.

11. The method of claim 9 wherein mass of the bolt is greater than about 1000 grains.

12. A method comprising:

(a) loading a shock-absorbing bolt onto a drawn crossbow; and (b) shooting the crossbow to launch the shock-absorbing bolt toward a ground surface, a tree, or a target to release safely energy stored by the drawn crossbow, wherein:

(c) the shock-absorbing bolt comprises (i) a shaft, (ii) a forward flange coupled to a forward end of the shaft, which forward flange comprises a structurally durable material and has a forward surface with a transverse area that is greater than about three times larger than a transverse area of the shaft, and (iii) a shock-absorbing mechanism coupled to the shaft or the forward flange, which mechanism is arranged so that, upon acceleration or deceleration of the bolt, kinetic energy of the bolt is dissipated by viscoelastic, viscous, or frictional forces within the bolt;

(d) the shock-absorbing mechanism includes a viscoelastic member and at least one movable member; and (e) the shock-absorbing mechanism is arranged so that acceleration or deceleration of the bolt results in movement of the movable member that deforms the viscoelastic member, thereby dissipating at least a portion of the kinetic energy of the bolt.

13. The method of claim 12 wherein the forward flange comprises metal.

14. The method of claim 12 wherein mass of the bolt is greater than about 1000 grains.

* * * * *